US007682107B2

(12) United States Patent
Crayne et al.

(10) Patent No.: US 7,682,107 B2
(45) Date of Patent: Mar. 23, 2010

(54) REMOTE MINE SEAL SPRAY NOZZLE ASSEMBLY, SYSTEM AND METHODS OF USE

(75) Inventors: Lynn M. Crayne, Jefferson, PA (US); Frank M. Howard, Venetia, PA (US)

(73) Assignee: Howard Concrete Pumping, Inc., Cuddy, PA (US)

( * ) Notice: Subject to any disclaimer, the term of this patent is extended or adjusted under 35 U.S.C. 154(b) by 575 days.

(21) Appl. No.: 11/392,288

(22) Filed: Mar. 29, 2006

(65) Prior Publication Data

US 2007/0228804 A1 Oct. 4, 2007

(51) Int. Cl.
*E21D 1/00* (2006.01)

(52) U.S. Cl. ..... 405/263; 405/266

(58) Field of Classification Search ..... 405/264, 405/263, 266; 239/419.3, 427
See application file for complete search history.

(56) References Cited

U.S. PATENT DOCUMENTS 3,802,203 A * 4/1974 Ichise et al. ..... 405/264

OTHER PUBLICATIONS

T. A. Gray, M. A. Trevits, L. M. Crayne and P. Glogowski, Demonstration of Remote Mine Seal Construction. 2004 SME Annual Meeting Denver, CO, Feb. 23-25 Preprint No. 04-194.

* cited by examiner

*Primary Examiner*—John Kreck
(74) *Attorney, Agent, or Firm*—The Webb Law Firm

(57) ABSTRACT

A remote mine seal spray nozzle assembly is provided that includes a rotatable nozzle body attached to a down shaft, multiple string casing. The nozzle body receives interchangeable nozzles coactively seated in a multiport manifold of the nozzle body casing. The nozzle defines a downstream spray outlet that projects a first mix formed of a cementitious grout including a water reducer and a plasticizer. The projected first mix is atomized with a second mix formed of pressurized air and a temperature optimized accelerant. An atomized mine seal mix is thereby created and projected from the downstream spray outlet to form a rapidly hardened mine seal from the accumulated mix projected from the nozzle. The multiport manifold seat establishes an upward directed spray throw axis whereby the projected mine seal mix is projected about a substantially upward arc to optimize the sealing capability of the remote mine seal.

22 Claims, 8 Drawing Sheets

REMOTE MINE SEAL SPRAY NOZZLE ASSEMBLY, SYSTEM AND METHODS OF USE

BACKGROUND OF THE INVENTION

1. Field of the Invention

The present invention relates to a spray nozzle assembly which can be useful for remote installation of sealant material in a mine entry to close the opening during heating events and other dangerous conditions that limit or prevent safe access to the mine.

2. Description of Related Art

For as long as minerals such as coal have been extracted from underground deposits, miners and underground workers have been confronted with hazards and dangerous events, often resulting in cessation of mining operations until underground conditions can be rendered safe. Such situations include, for example, accumulation of toxic and explosive gases, underground fires or heating events, flooding, and combinations thereof. The interruptions in operation result in lost revenue from lack of product sales, and ultimate loss of workforce and customers when the dangerous conditions can only be remedied over extended periods of time.

Many attempts have been made to render hazardous conditions safe for continued underground operations. For example, the mine can be sealed for long periods of time to allow flood waters naturally recede or a fire to burn itself out from lack of combustible materials and/or oxygen and to permit the surrounding areas to cool and dissipate toxic and/or explosive gases.

Alternatively, the unsafe areas of the mine can be isolated from other working areas by installing strong, generally airtight seals between the unsafe areas and working areas. This approach is also used to seal off smaller segments of the underground workings to contain toxic gases or cut-off air supply so that a fire can extinguish itself in a shorter period of time.

Such sealing efforts can also enable exchange of the atmosphere near the hazard with inert gas to extinguish a fire or to displace toxic or explosive gas, as well as to introduce a breathable atmosphere as needed. In gaseous underground workings such as coal mines, workers can experience significant increases in amounts of methane gases, as well as in underground heating event scenarios where black and white damp can displace breathable air. Black damp generally refers to carbon dioxide, but is more specifically used to refer to mixtures of carbon dioxide and nitrogen, as well as to oxygen depleted atmospheres. White damp generally refers to carbon monoxide that can predominate afterdamp atmospheres resulting from fires, blasting, explosions of gas, coal-dust, or other underground contaminants.

In the past, such sealing efforts have been ineffective as it is difficult to install a seal near the fire or source of unsafe gas(es). To be effective, the mine seal should extend across the ribs or sidewalls, and from floor to roof of an entry, and have a thickness and depth sufficient to withstand explosion or the weight of dammed-up flood water. Such seals are typically used to isolate the fire area and to limit the inflow of oxygen. Once an area is sealed, the fire can be more readily controlled or suppressed by flooding the area behind the seals with water, gas-enhanced foam, inert gas, silt or other material. Such seals have been made from wood, steel, concrete, and grout materials when the seal can be constructed from underground locations near the hazard or problem area.

However, most underground mines cannot dissipate heat or gas except through nearby passageways. Such passageways can extend for miles before reaching vents, which are usually the mine adits or entries. Therefore, it can be difficult to install a seal in underground locations near the problem area. Attempts have been made to remotely install a seal close to a problem area from a location that is a safe distance from the dangerous problem area ("PA"), such as from the surface ("S"). As shown in FIG. 1, a drill rig ("DR") can be positioned to drill a down shaft, hole, or bore ("DS") near the problem area.

However, such efforts have been less than satisfactory because it is difficult to install a seal close enough to the problem area or to effectively seal the passageway or entry. In many remote seal installations, it has been difficult to adequately close gaps between the top of the seal and the roof of the problem area PA because the body of the seal base can shrink and settle after installation, creating gaps therebetween.

Despite these problems, mine operators and government legislators in the United States and elsewhere seek to reduce the hazards confronting underground workers by focusing on improving the state of the art of remote seal construction and installation. Therefore, there is a need in the art for apparatus and systems that are capable of use for remote sealing of underground passageways or entries to close the opening during heating events and other dangerous conditions that limit or prevent safe access to the underground works.

SUMMARY OF THE INVENTION

The present invention provides a remote mine seal spray nozzle assembly, comprising: (a) a nozzle body comprising an outer casing end and an opposed, spray end, an inner conduit, and at least one outer conduit extending between the outer casing end and the spray end, the spray end comprising a multi-port manifold seat in fluid communication with the conduits; and (b) a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat.

The present invention also provides a system for remote operator monitoring of a mine seal installation through an observation shaft using the remote mine seal spray nozzle assembly.

A method for installing a remote mine seal through a bore hole is provided using a remote mine seal spray nozzle assembly comprising a nozzle body comprising an outer casing end and an opposed, spray end, an inner conduit, and at least one outer conduit extending between the outer casing end and the spray end, the spray end comprising a multi-port manifold seat in fluid communication with the conduits; and a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat; the method comprising the steps of:

a) positioning the remote mine seal spray nozzle assembly through a seal bore hole and about a seal installation area;

b) charging the outer conduit with pressurized gas and an accelerator;

c) charging the inner conduit with a spray material to be atomized in the interior mixing chamber by the pressurized gas and accelerator charge and to be discharged as mixed seal material through the spray outlet; and d) rotating the nozzle body and directing the discharged mixed seal material about the seal installation area to remotely install the mine seal.

BRIEF DESCRIPTION OF THE DRAWINGS

The present invention will best be understood from the following description of specific embodiments when read in connection with the accompanying drawings.

DESCRIPTION OF THE PREFERRED EMBODIMENT(S)

Figure 1:
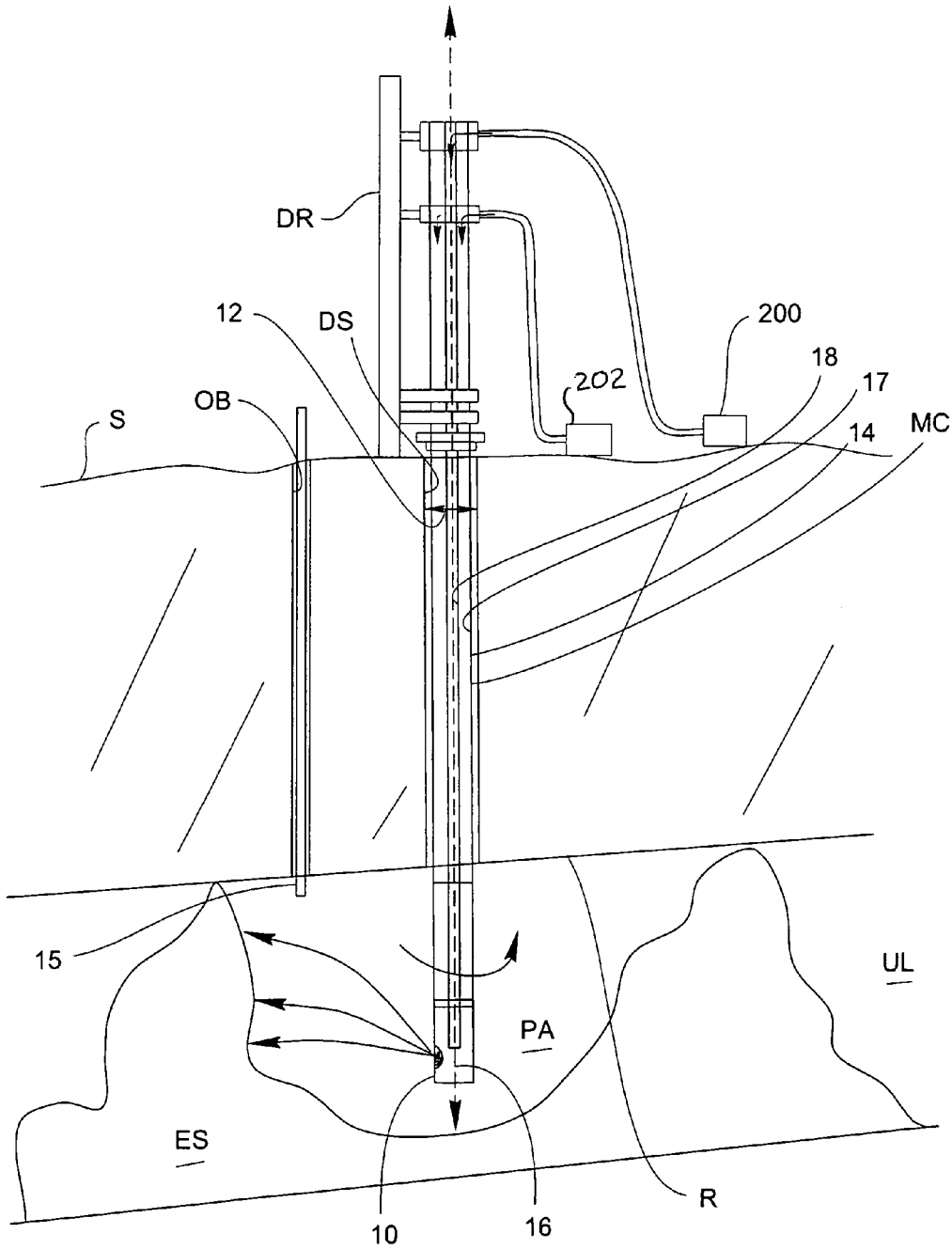
FIG. 1 is a front elevational view of drill rig in operation including a remote mine seal spray nozzle assembly according to the present invention.

Other than in the operating examples or where otherwise indicated, all numbers or expressions referring to quantities of ingredients, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

The remote mine seals formed using the nozzle assembly 10 of the present invention can permit faster egress to an underground entry during or after an event, such as fire, gas buildup or flooding, by providing apparatus and methods to remotely install a mine sealing material in an underground entry or opening. The nozzle assembly 10 of the present invention can be quickly deployed for rapid installation of a mine seal. Also, the nozzle assembly 10 of the present invention is cost-effective due to the ability to use non-combustible mine seal material that is locally available to the mine site for the mine sealant material. The nozzle assembly 10 of the present invention permits use of grout material that allows placement in void spaces without excessive flow from the problem area if the mine is open and unobstructed, yet has flowable characteristics to fill void spaces should the mine opening contain roof fall debris, cribbing, posts, equipment and conveyor structures. The nozzle assembly 10 of the present invention can facilitate construction of mine seals having full mine roof-to-floor and rib-to-rib closure and that can be capable of withstanding the force of a mine explosion up to 20 psi.

The present invention in its various embodiments is directed to a remote mine seal spray nozzle assembly 10 that can be deployed from a surface area S to a problem area PA in an underground location ("UL"), as is generally depicted in FIG. 1. For example, the surface area S can be the ground surface which is exposed to the environment or atmosphere in the region above the problem area PA. Generally, the remote mine seal spray nozzle assembly 10 can be deployed from any location in the mine above the problem area PA and/or from the surface S. The problem area PA can be, for example, a mine shaft or entry in an underground location UL, such as a mining operation.

The remote mine seal spray nozzle assembly 10 of the present invention is deployed to install an entry seal ("ES") proximate to the problem area PA. Remote deployment of the assembly 10 permits the sealing material feed equipment (not shown) and operator (not shown) to remain at a location that is a safe distance from the dangerous problem area PA to prevent possible injury to the feed equipment or operator.

Referring now to FIG. 1, a drill rig DR is positioned to sink a down shaft, hole, or bore DS near the problem area PA. Typically, the drill rig DR as shown includes a crane assembly that enables sinking of a multistring casing ("MC") with conduits through the ground to penetrate the underground location UL in the region of the problem area PA in which the entry seal ES is to be installed. Suitable drill rigs and crane assemblies are well known to those skilled in the art and include, for example, Davey drill rigs which are commercially available from Davey Drill of Kent, Ohio. The diameter 12 of the down shaft hole DS can be any diameter desired that is greater than the outer diameter of the nozzle assembly 10, and is preferably sized to prevent backflow of sealing material up through the down shaft hole DS. In some embodiments, the diameter 12 of the down shaft hole DS is at least about 8 inches (about 20 cm).

The multistring casing MC comprises interconnecting conduits 14 along the length of the down shaft hole DS which connect the drill rig DR to the nozzle assembly 10 and permit rotation of the nozzle assembly 10 about a longitudinal axis 16 thereof. The outer diameter of the multistring casing MC can be about the same as the outer diameter of the nozzle assembly 10, as discussed in detail below, but is less than the diameter 12 of the down shaft hole DS. The multistring casing can be formed from any suitable metal resistant to the wear conditions to be encountered in the drilling and sealing operation, for example high carbon steel.

Each conduit 14 includes an outer conduit 17 and an inner conduit 18 positioned concentrically within the outer conduit 17. As discussed in detail below, the first mix of cementitious grout material is fed through the inner conduit 18 and the second mix of pressurized air and accelerant is fed through the outer conduit 17. The inner diameter of the outer conduit 17 can range from about 4 to about 5 inches (about 10 cm to about 13 cm), and is preferably about 4⅝ to 4¾ inches. The outer diameter of the inner conduit 18 is less than inner diameter of the outer conduit 17, and can range from about 3 to about 4 inches (about 7.5 to about 10 cm), preferably about 4 inches.

An observation bore OB can be created near the down shaft hole DS to enable remote monitoring of environmental conditions and or viewing with a device or sensor a positioned proximate the remote mine seal capable of communicating information through the observation bore to the operator. Non-limiting example of such devices or sensors include a self-illuminating audio-visual device such as a video camera, an anemometer, an air flow visualization smoke trail generator, or other type of device or sensor package 15 or combination thereof.

Figure 2:
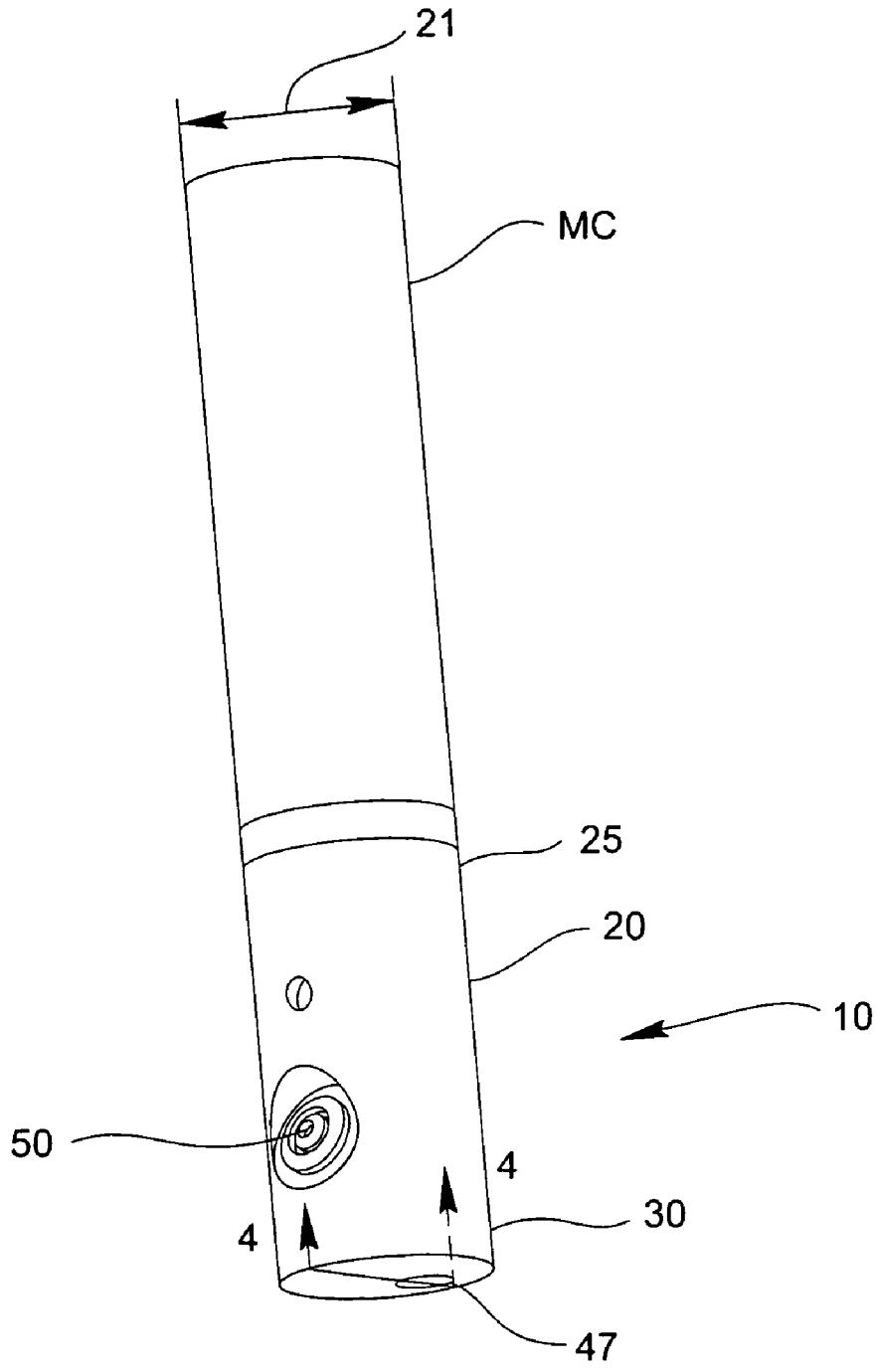
FIG. 2 is a portion of the structure of the remote mine seal spray nozzle assembly of FIG. 1 connected to a segment of a down-hole casing.
Figure 3:
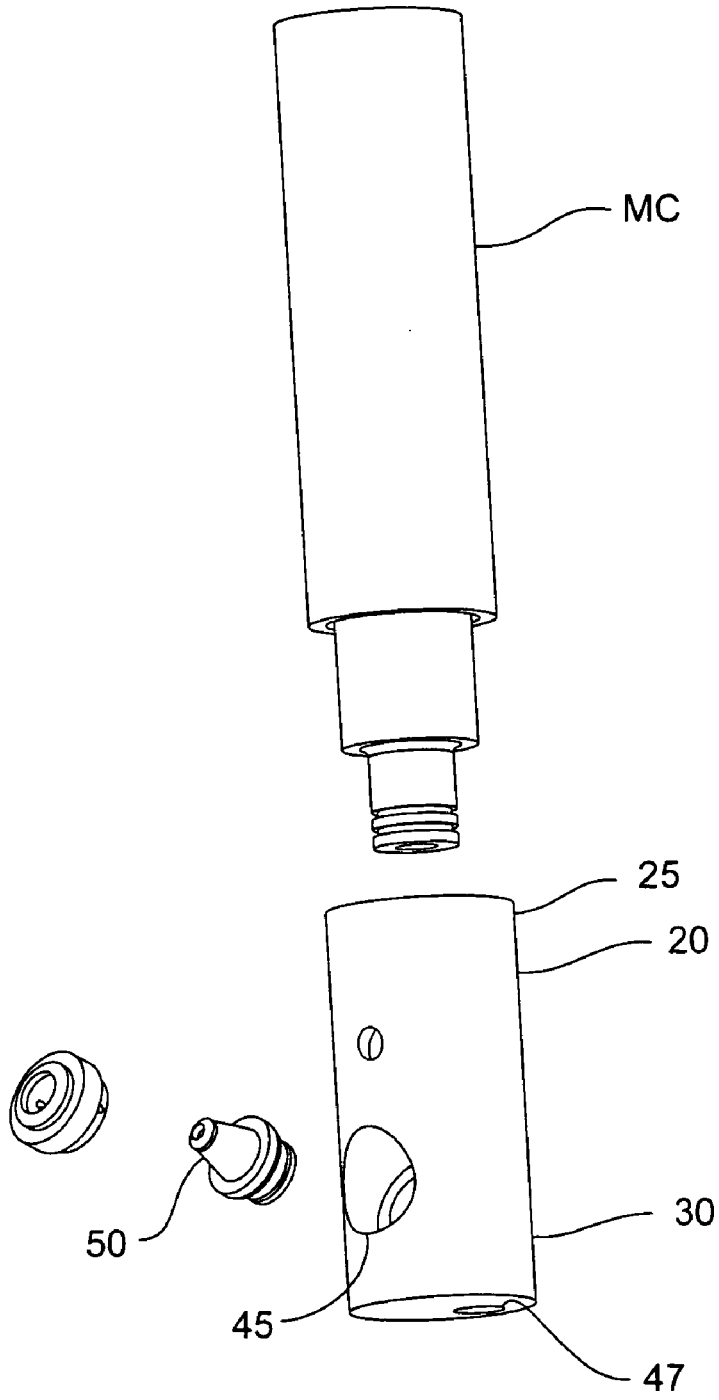
FIG. 3 is an exploded view of the remote mine seal spray nozzle assembly and down-hole casing of FIG. 2.

Referring now to FIGS. 2 and 3, the remote mine seal spray nozzle assembly 10 comprises a nozzle body 20. The nozzle body 20 is generally cylindrical in shape and has a outer diameter 21 ranging from about 4 inches to about 8 inches (about 10 cm to about 20 cm), and in other embodiments is about 5½ inches (about 14 cm). The outer diameter 21 of the nozzle body 20 is less than the diameter 12 of the down shaft hole DS. The length 23 of the nozzle body 20 can vary as desired, and can range, for example, from about 12 inches to about 24 inches (about 30 to about 61 cm), preferably about 12 inches. The nozzle body 20 can be formed from any suitable metal resistant to the wear conditions to be encountered in the drilling and sealing operation, for example high carbon steel.

Figure 4:
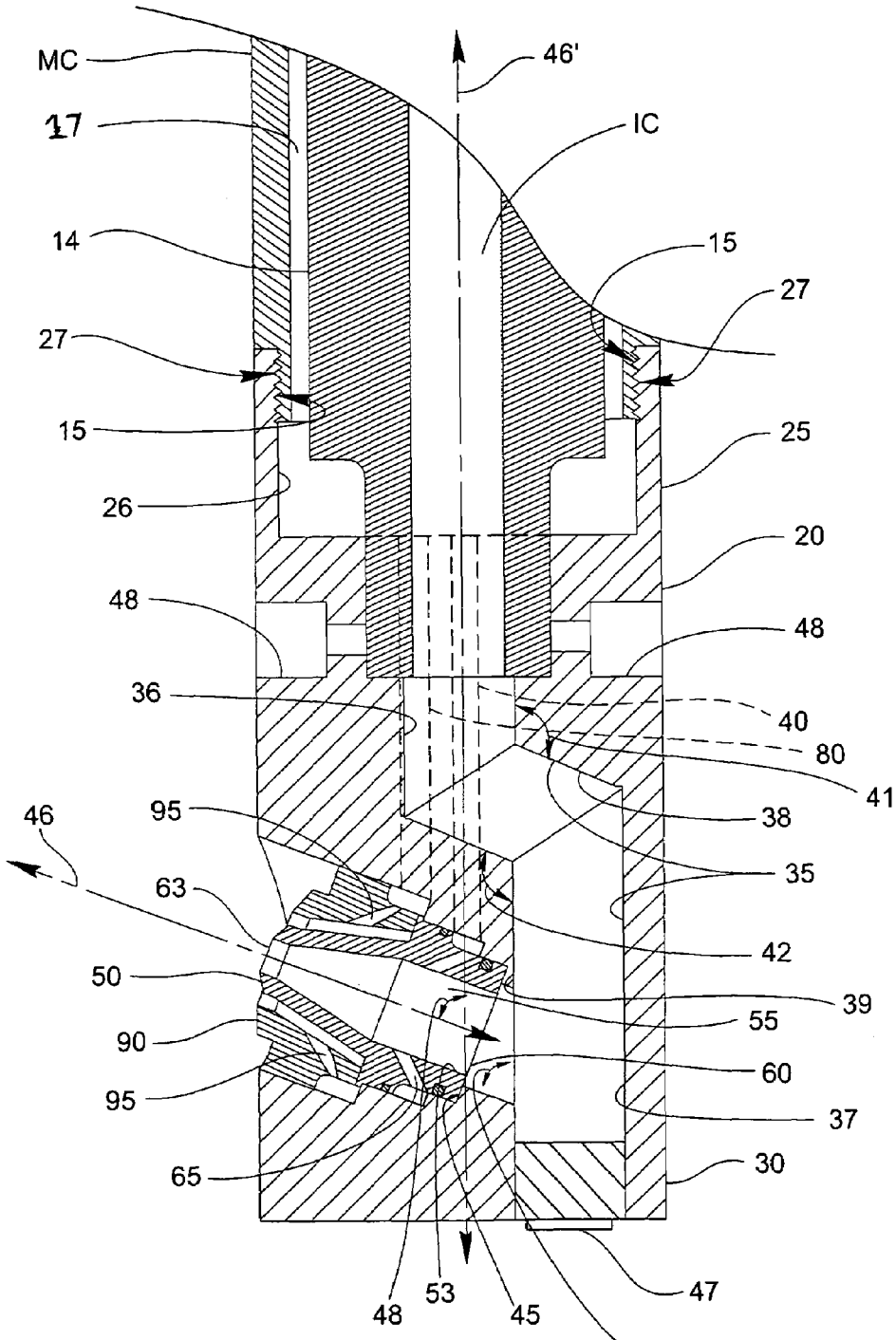
FIG. 4 is a cross-sectional view of a portion of the casing and remote mine seal spray nozzle assembly of FIG. 2, taken across lines 4-4 of FIG. 2.

The nozzle body 20 comprises an outer casing end 25 opposite the spray end 30. The outer casing end 25 of the nozzle assembly 10 is fluidly connected to interconnecting conduits 14 of the multistring casing MC to permit sealant material to flow therethrough. As shown in FIG. 4, the outer casing end 25 includes a generally cylindrical recess 26 for receiving an interconnecting conduit 14. In some embodiments, the recess 26 can comprise a threaded receiver portion 27 for receiving and securing a mating threaded portion 15 of the interconnecting conduit 14. In other embodiments, a gasket or sealing material can be inserted between the recess 26 and mating portion of the conduit 14 to provide a seal therebetween.

As shown in FIGS. 3 and 4, the nozzle body 20 comprises an inner conduit 35. The inner conduit 35 is preferably generally circular in cross section and comprises a generally cylindrical upper portion 36 and an offset, generally cylindrical lower portion 37. The upper portion 36 and lower portion 37 are fluidly connected by a generally cylindrical angled portion 38 therebetween. The angled portion 38 is preferably positioned at an obtuse angle 41 with respect to the upper portion 36 ranging from about 95 degrees to about 120 degrees, such as about 120 degrees. The angled portion 38 is preferably positioned at an obtuse angle 42 with respect to the lower portion 37 ranging from about 95 degrees to about 120 degrees, such as about 120 degrees. The inner conduit 35 also comprises a second angled portion 39 which is positioned at an acute angle 42 with respect to the opposite end of the lower portion 37 ranging from about 70 degrees to about 85 degrees, such as about 60 degrees. The second angled portion 39 is positioned between the lower portion 37 and the grout inlet 60.

The diameters of the upper portion 36, lower portion 37, angled portion 38 and second angled portion 39 of the inner conduit 35 are preferably the same, although the diameters of each portion 36, 37, 38 and 39 can vary as desired. Preferably the respective diameters of the upper portion 36, lower portion 37, angled portion 38 and second angled portion 39 of the inner conduit 35 independently range from about 1 inch to about 2 inches (about 2.5 cm to about 5 cm), preferably about 1.25 inches (about 3 cm).

The inner conduit 35 provides a passageway through which the first mixture of cementitious grout (discussed below) flows from the inner conduit 18 of the multistring casing MC to the grout inlet 60 of the interior mixing chamber 55 discussed below.

As shown in FIGS. 3 and 4, the nozzle body 20 also comprises at least one outer conduit 40. The outer conduit 40 is preferably generally cylindrical and has a diameter ranging from about 0.25 inch to about 1 inch (about 0.6 cm to about 2.5 cm), preferably about ½ inch (about 1.2 cm). The outer conduit 40 provides a passageway through which the second mixture comprising pressurized air and accelerant (discussed below) flows from the outer conduit 17 of the multistring casing MC to the charging pressure port 65 to the interior mixing chamber 55, as discussed below The spray end 30 of the nozzle body 20 comprises a multi-port manifold seat 45 (see also FIG. 8) in fluid communication with the conduits 35, 40.

The multi-port manifold seat 45 is generally cylindrical and preferably comprises a substantially cylindrical recess therethrough about a centrally positioned spray or throw axis 46 that approximately defines an acute throw or spray angle 48 with a first or longitudinal axis 46' of the nozzle body. The spray angle 48 can range from about 45 degrees to less than about 90 degrees, preferably about 60 degrees.

In some embodiments, the nozzle assembly 10 can further comprise a blow out plug 47 at the spray end 30, which can be removed to clean out the interior and conduits 35, 40 of the nozzle body 20. In some embodiments, the nozzle assembly 10 can further comprise one or more cleanout port(s) 48 to facilitate cleaning of the inner conduit 35. The respective diameters of the blow out plug 47 and cleanout port(s) 48 can vary, as desired, to facilitate cleaning of the nozzle assembly 10.

Figure 6:
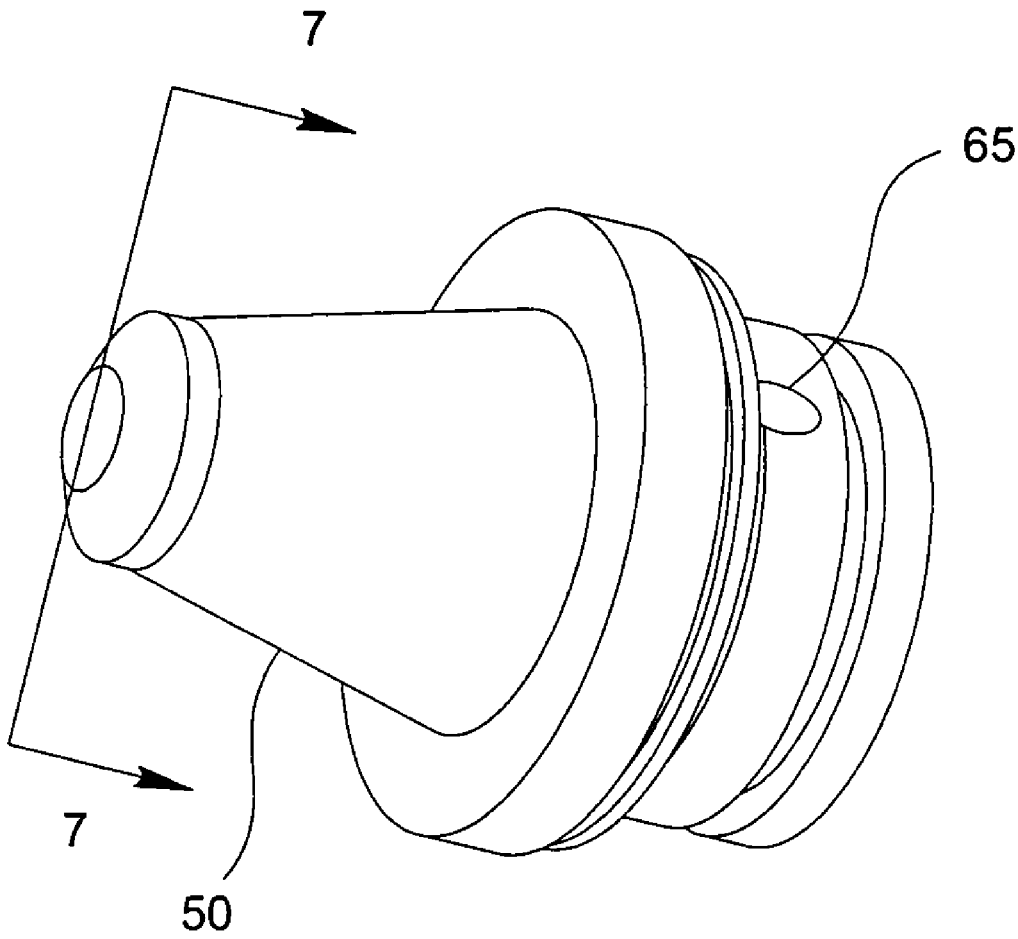
FIG. 6 is a perspective view of a nozzle component of the remote mine seal spray nozzle assembly according to the present invention.
Figure 7:
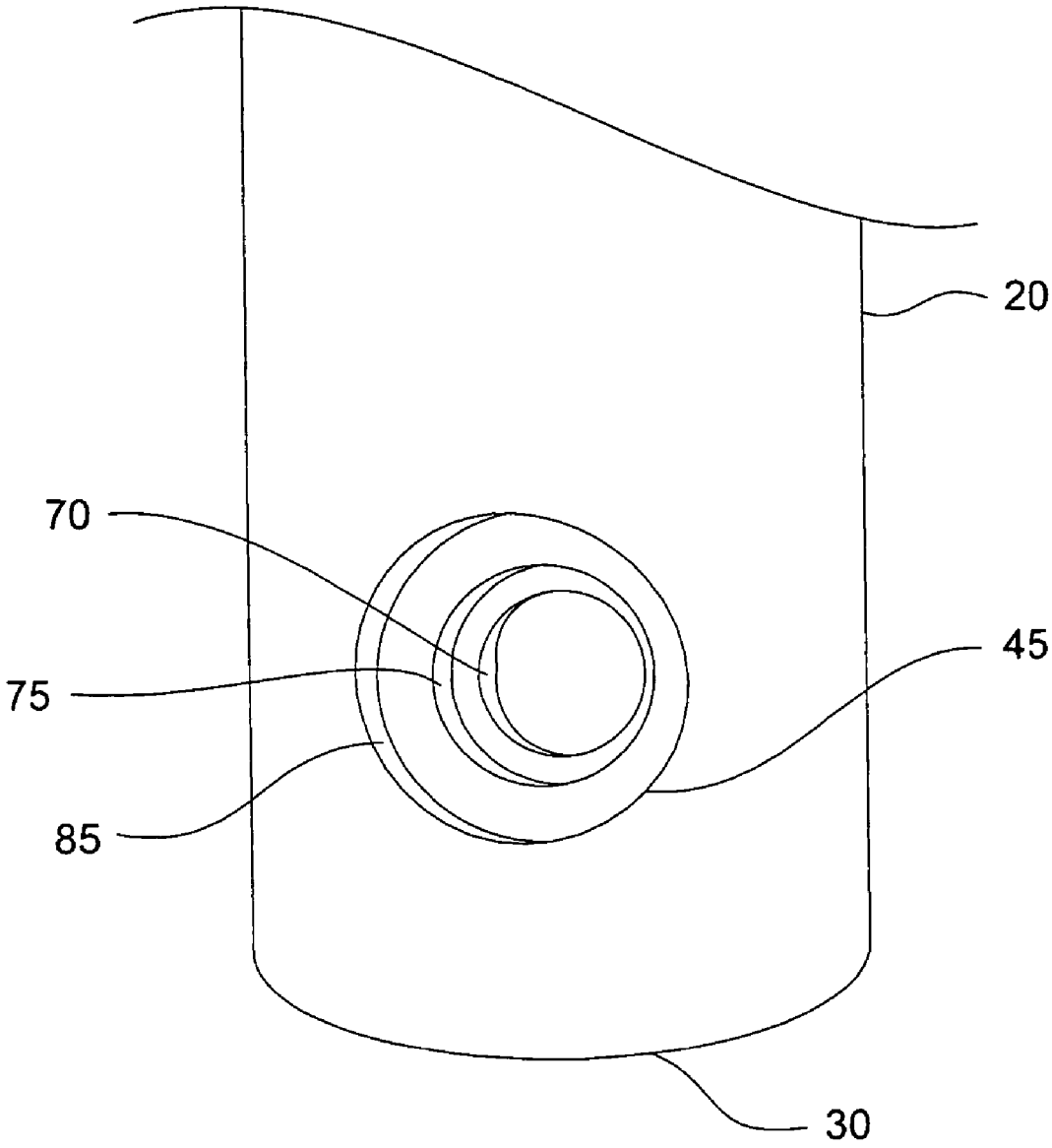
FIG. 7 is a perspective view of a nozzle body component of the remote mine seal spray nozzle assembly according to the present invention.

The nozzle assembly 10 also comprises a nozzle 50 (shown in more detail in FIG. 6) that is received in the multi-port manifold seat 45. The nozzle 50 preferably defines an interior mixing chamber 55 having a grout inlet 60 that is positioned opposite a downstream spray outlet 63, and at least one charging pressure port 65 in fluid communication with the chamber 55 and being positioned between the grout inlet 60 and the spray outlet 63. When received in the multi-port manifold 45, the substantially cylindrical nozzle 20 also defines the spray or throw axis 46 described above in connection with the multi-port manifold seat. Preferably, the axis 46 defines the direction of spray, throw, or projection of the nozzle 20. More preferably, the axis 46 defines a generally upward direction that establishes a corresponding upward spray direction, which can result in the nozzle spraying a further distance.

The nozzle 20 can further comprise one or more gaskets 22 positioned between the exterior portion of the nozzle 20 and the multi-port manifold seat 45 to inhibit leakage of the sealant material therebetween. The gaskets can be formed from any elastomeric material that is resistant to degradation by contact with the sealant materials, for example neoprene. The thickness of the gasket(s) 22 can range from about 0.1 to about 0.3 inches (about 0.25 cm to about 0.8 cm), preferably about 0.2 inches (about 0.5 cm).

The overall length 52 of the nozzle 50 can range from about 3 to about 5 inches (about 7.5 to about 13 inches), and is preferably about 3 inches (about 7.5 cm), but preferably does not protrude beyond the end of the retainer 90, as discussed below.

In some embodiments, the nozzle 50 comprises a generally cylindrical first portion 53 having a plurality of apertures or charging pressure ports 65 therethrough. The number of charging pressure ports 65 can vary as desired, but preferably ranges from about 4 to about 10, and more preferably is 8. The diameter of each charging pressure port 65 can vary as desired, but preferably ranges from about 0.2 inches to about 0.5 inches (about 0.5 cm to about 1.3 cm), preferably about 0.25 inches (about 0.6 cm). The sum of the diameters of the ports 65 preferably equals the diameter of the outer conduit 40.

The interior diameter of the nozzle 50 can be uniform along the length of the nozzle 50, but preferably narrows or tapers toward the spray outlet 63. The interior diameter of the nozzle 50 proximate the grout inlet 60 can range from about 1 inch to about 2 inches (about 2.5 to about 5 cm), preferably about 1.25 inches (about 3.2 cm). The interior diameter of the nozzle 50 proximate the spray outlet 63 can range from about 0.5 inches to about 1 inch (about 1.3 cm to about 2.5 cm), preferably about 0.75 inches (about 1.9 cm).

The grout inlet 60 is in fluid communication with the inner conduit 35 through the multi-port manifold seat 45. The charging pressure port 65 is in fluid communication with the at least one outer conduit 40 through the multi-port manifold seat 45.

The spray nozzle assembly 10 can further comprise a second outer conduit 80 formed in the outer portion or casing of the nozzle body 20. The second outer conduit 80 can be choked to adjust the flow rate therethrough by selecting a suitable diameter of the conduit 80 or an inlet thereof. The inner diameter of the second outer conduit 80 can range from about 0.25 inch to about 1 inch (about 0.6 cm to about 2.5 cm), preferably about ½ inch (about 1.2 cm).

Figure 5:
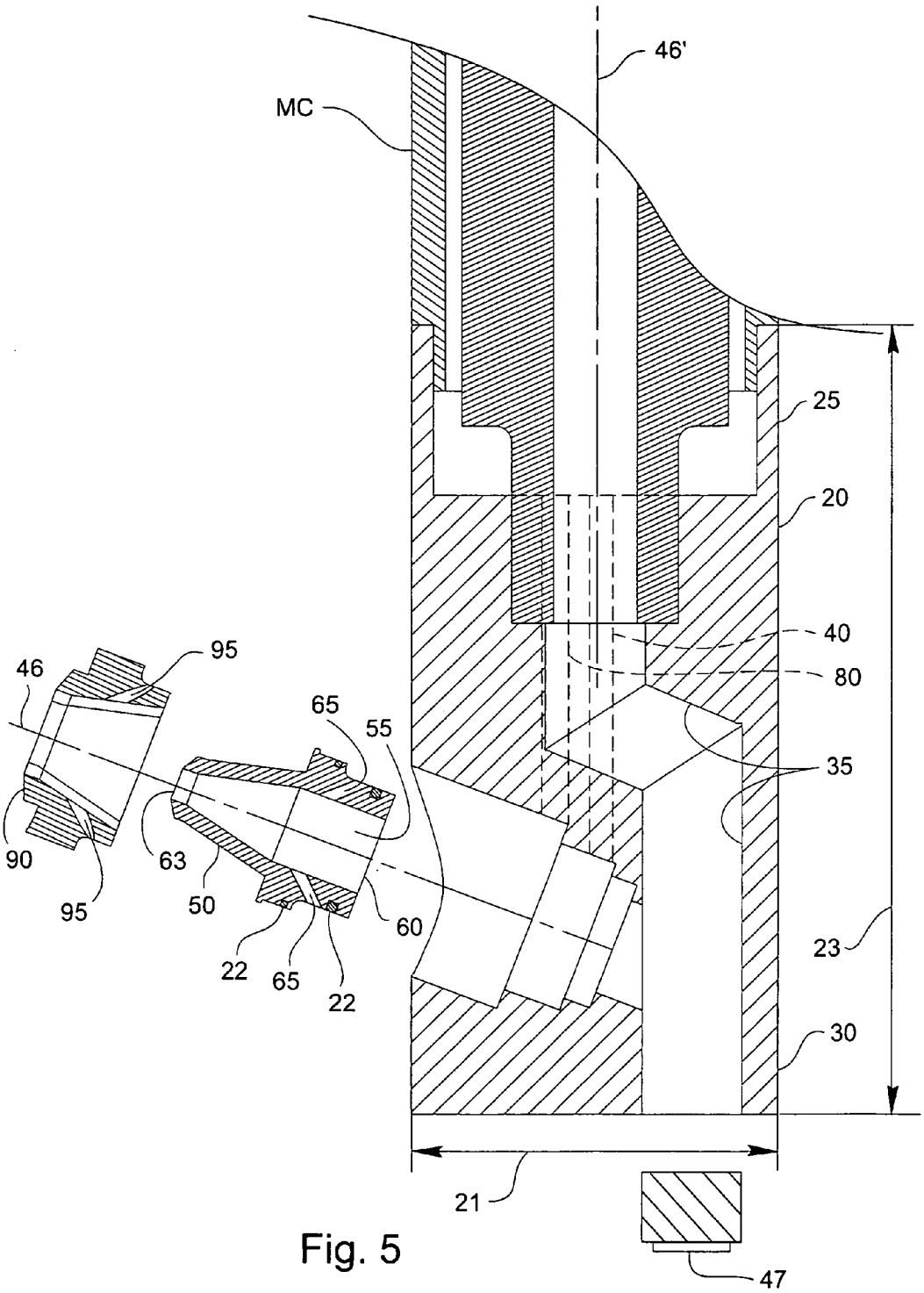
FIG. 5 is an exploded cross-sectional view of the remote mine seal spray nozzle assembly of FIG. 4.
Figure 8:
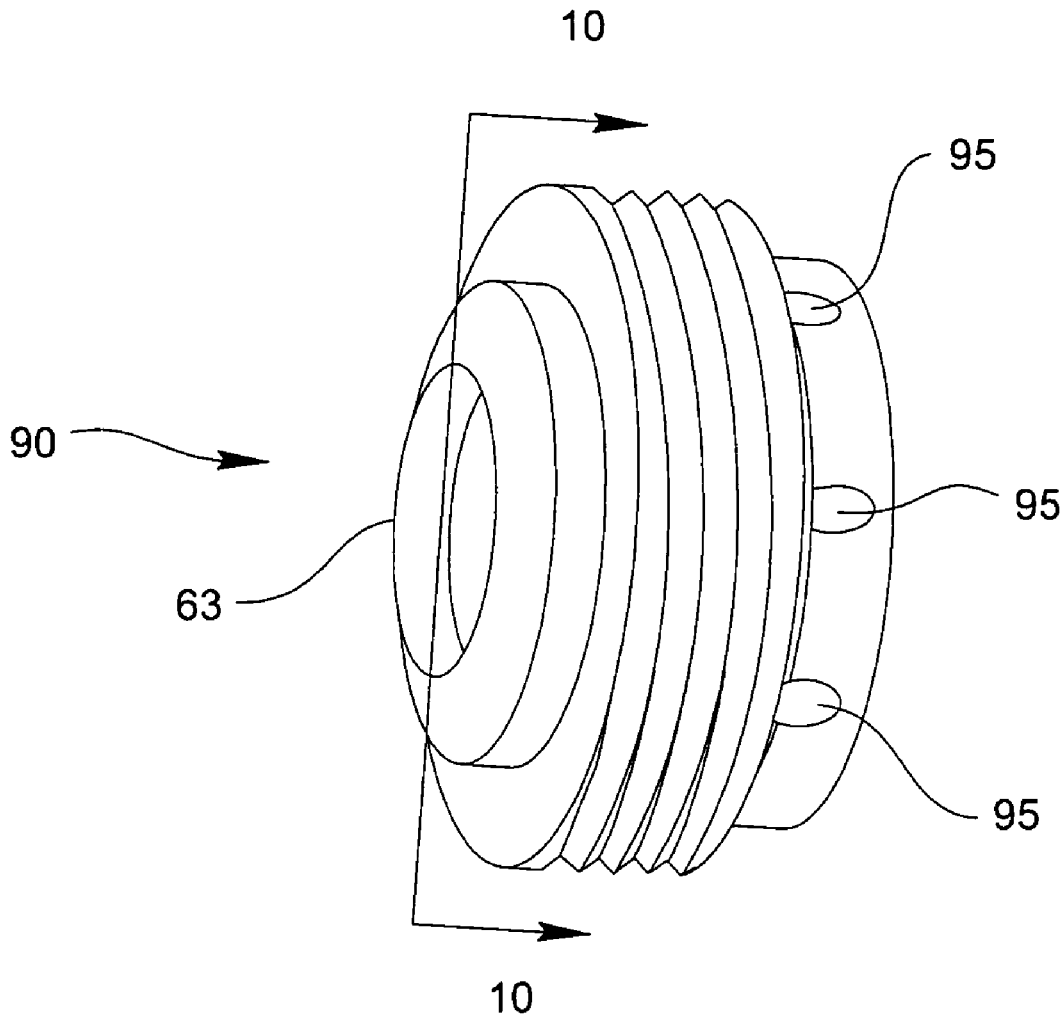
FIG. 8 is a perspective view of a retainer component of the remote mine seal spray nozzle assembly according to the present invention.

In some embodiments, with reference to FIGS. 4, 5 and 8, the spray nozzle assembly 10 further comprises a ring or retainer 90 that captures the nozzle 20 in the multi-port manifold seat 45. In some embodiments, the retainer 90 comprises one or more second charging pressure port(s) 95 that are in fluid communication with the second outer conduit 80 and with the downstream spray outlet 63. The retainer 90 preferably threadably captures the interchangeable nozzle 50 in the multi-port manifold seat 45. A shown in FIG. 8, in some embodiments, an exterior portion of the retainer 90 is threaded to be received and retained in a mating threaded portion of the multi-port manifold seat 45. Interchangeability of nozzles 50 enables selection of variously sized inlets 60, outlets 63, and charging ports 65, 95.

The number of second charging pressure ports 95 can vary as desired, but preferably ranges from about 4 to about 10, and more preferably is 8. The diameter of each charging pressure port 95 can vary as desired, but preferably ranges from about 0.2 inches to about 0.5 inches (about 0.5 cm to about 1.3 cm), preferably about 0.25 inches (about 0.6 cm). The sum of the diameters of the ports 95 preferably equals the diameter of the second outer conduit 80.

In operation, the remote mine seal spray nozzle 10 is part of and is used in a system that includes equipment to prepare and transfer the mine seal raw materials to the remote, underground problem area PA (FIG. 1). The materials are fed in two parts. A first mix is formed of a cementitious grout comprising cement (such as Portland cement), fly ash and water. The first mix can also comprise a water reducer, a plasticizer and/or catalyst, as well as any other constituents. The first mix is pressure fed from a supply 200 (such as a pump truck) through the inner conduit 18 of a multi-casing conduit MC through downshaft DS to supply the remote mine seal spray nozzle assembly 10.

A second mix is prepared comprising pressurized air and an accelerant suspended in the pressurized air stream. The temperature and quantity of accelerant can be adjusted to affect the cure rate based upon the temperature in the problem area PA. The temperature of the second mix can range from about 40° F. to about 90° F. The second mix is pressure fed from a supply 202 through the outer conduit 17 of the multi-casing conduit MC through downshaft DS to supply the at least one charging pressure port 65 of the mixing chamber 55 and optionally to other charging ports of the remote mine seal spray nozzle 10.

As the first and second mixes are combined and mixed in the mixing chamber 55, the pressure of the first mix and the pressurized second mix atomize the combined mixture into an atomized mine seal mix. Once mixed, the mine seal mix is ejected from the downstream spray outlet 63 of the interior mixing chamber 55. The mine seal mix is sprayed about the problem area PA of the entry to accumulate and form a mine seal MS. As a result of the accelerant and other constituents of the mine seal mix, a mine seal MS is formed that rapidly hardens. As the mine seal mix is continuously sprayed about the problem area PA, the mine seal MS grows in size to seal the entry.

Additionally, as a result of the substantially upward angled projected spray, the inventive remote mine spray nozzle assembly 10 can be rotated to spray about the problem area PA and to seal any possible gaps between the top of the mine seal MS and the roof ("R") or ceiling of the entry. Those skilled in the art will understand from this description that the remote mine seal spray nozzle assembly 10 is used by first positioning the remote mine seal spray nozzle assembly 10 through a seal bore or downshaft hole DS and about a seal installation or problem area PA.

During discharge of the mine seal mix, the nozzle body 20 is rotated to direct the discharged mine seal material or mix about the seal installation or problem area PA, which remotely installs the mine seal MS. In some embodiments, a third material such as a grout resin may be injected or sprayed through the remote mine seal spray nozzle assembly 10 about the seal installation or problem area PA. This optional variant may be preferred for reinforcing the mine seal MS and for sealing any gaps that may arise between the mine seal MS, the ribs or walls, or the roof or ceiling R of the entry.

This added process can be especially useful for certain types of mine seal mixes that may shrink over time during curing and as a result of unexpected temperature changes in the entry. Such temperature changes can result after a fire is extinguished and residual heat dissipates. Also, the mine seal installation process may be confirmed and observed during operation through use of any of the monitoring devices 15 (FIG. 1) that may be positioned on either side of the mine seal MS.

The present invention will further be described by reference to the following examples. The following examples are merely illustrative of the invention and are not intended to be limiting. Unless otherwise indicated, all percentages are by weight unless otherwise specified.

EXAMPLE

Remote construction of mine seals using the nozzle assembly and methods of the present invention was evaluated at the NIOSH Lake Lynn Experimental Mine (LLEM) located approximately 60 miles southeast of Pittsburgh, Pa. The LLEM is a world-class, highly sophisticated underground facility where large-scale explosion trials and mine fire research is conducted. A 6-in diameter cased borehole was drilled and completed in the first cross-cut between the B and C Drifts of LLEM and it was determined that this borehole was suitable for the seal construction work. The thickness of the overburden in the area of the borehole was 197 ft. The cross-cut in the mine measured 19 ft wide, 40 ft long and 7 ft high, with a mine floor slope gradient of 1.13 percent. A second borehole, located about 30 ft away, was available for viewing the mine seal installation using a downhole video camera.

A model mine opening was constructed at assignees' facility for testing and direct observation of the performance of the downhole and surface equipment. The model mine opening consisted of a small excavation in a hillside. The roof of the model mine was made using crane mats so a drill rig could be located over the mine void to hold the pipe for the downhole equipment. Two series of tests were performed at the model mine along with an initial test at the LLEM before the final seal material delivery technology and seal grout mixture was developed.

The final technique developed included a directional elbow for directional placement of bulk fill material and a spray nozzle as described above according to the present invention to provide sealant material to fill the remaining open areas in the mine void. The spray nozzle required the use of two strings of pipe (one inside of the other) to convey two streams of material to the nozzle. The spray nozzle permitted the blending of the two-part grout accelerator mix with sufficient air velocity to transport the grout to the mine roof-and-rib areas. The bulk grout was pumped to the borehole using a positive displacement pump and compressed air. The sprayed grout was moved to the borehole using a conventional grout pump and compressed air.

During the initial work, it was decided that the first material to be placed into the mine would be a bulk fill material designed to occupy most of the open space in the mine void. The bulk fill material was comprised of a mixture of fly ash, Portland cement, and 2A (¾-in minus) crushed limestone aggregate. A conventional concrete admixture was used to accelerate the set of the grout. The material was blended to achieve a pumpable mixture that had adequate strength and rapid setting properties. Fly ash was added to produce a mix that could be pumped to the borehole, travel down the borehole without segregation and provide a moderate degree of flowability. Once the material was in-place, the aggregate would provide sufficient shear resistance for the grout to be somewhat immobile until the mix set. Typical initial set time for this mixture could be achieved in 15 to 20 minutes and would support foot traffic in 30 to 45 minutes.

A second sealant material was used to fill the remaining open space above the bulk fill especially along the problematic roof-rib line areas. This sealant material consisted of a two-part grout blend. The grout was a mixture of ASTM Class-F fly ash, Portland cement, water reducer and catalyst. Part A improved the pumping characteristics and provided a reaction platform for Part B and was mixed with the grout before it was pumped into the borehole. Part B was prepared to create an immediate stiffening of the grout. Part B was added to the grout mixture at the spray nozzle (positioned at the mine level) using the stream of air that also transports the grout to the mine roof-and-rib surface. The reaction between the Part A and Part B admixtures essentially provided the initial stiffening of the proprietary mixture. Accelerating the hydration process facilitated rapid strength development of the in-place grout. To improve the stiffening properties of the grout and produce the required stickiness for the grout spray to adhere to the mine roof-and-rib areas, the water content of the mix was also adjusted to adjust set time.

Mine Seal A

The equipment used for this work included a volumetric mixer batch plant, cement storage silo, water tanks, pumps, air compressor, a drill rig, and miscellaneous support equipment such as trucks and loaders. Initial operations included calibrating the batch plant so that a uniform flow of bulk material could be mixed to produce a rate of approximately 30 cubic yards of material per hour. Pumping of the first part of seal (bulk material) began using a sand, fly ash and cement mixture. This material was pumped into the mine opening using the directional elbow. The bulk material was pumped in a series of lifts to fill most of the mine opening. Pumping was terminated after approximately 55 $yd^3$ of material had been placed into the cross-cut. It should be noted that communication with underground personnel was allowed to orient the directional elbow and complete the construction of the first part of the seal. Underground examination revealed that seal material was placed to within 1.5 ft of the mine roof below the borehole and within 2.5 to 3 ft of the mine roof near the rib areas (FIG. 8).

It was decided to remove 6 in of material at the top of the seal to allow sufficient room to test the capability of the spray nozzle. For this part of the seal installation, the raw material was brought to the site using redi-mix trucks. This equipment worked well with the small volume batch plant used for this work. After conducting a 10 $yd^3$ surface test of the proprietary seal mixture (fly ash, cement and accelerators), a dual string of drill pipe and casing affixed with the spray nozzle was then placed into the borehole in preparation for the second part of the seal construction. Once the nozzle penetrated the mine opening, seal material was sprayed in a back-and-forth motion along the mine rib areas to fill in the gaps. Interaction between observers underground and engineers on the surface ensured that the nozzle was aimed in the proper direction. Good mine roof-and-rib contact was made with the proprietary sprayed material. The problematic corner areas at the mine roof-rib intersection were filled before the grout began to build up and migrate towards the spray nozzle.

Filling of the remaining area near the borehole was accomplished by lowering the spray nozzle into the wet material and then rotating the operating spray nozzle through a 360 degree arc. Eventually, the material built-up around the proprietary nozzle and closed the mine opening. In all, a total of 22.5 $yd^3$ of sprayed material was used to close the mine opening. An underground examination showed that the mine seal material (both bulk and sprayed material) was sprayed about 12 ft from the borehole towards the B-Drift and only about 9 ft from the borehole towards the C-Drift (this reduced distance was due to the slope of the mine floor). The final shape of the seal approximated a truncated pyramid whose base measured 19 ft wide (the width of the cross cut) by 21 ft deep and whose top measured 19 ft wide (the width of the cross cut) by 3 to 5 ft deep. Later, the mine seal was removed using permissible explosives and permissible blasting techniques.

Mine Seal B

The design concept for mine seal B called for only using the spray nozzle and eliminating the bulk component of the fill. The material mix was altered somewhat from that used for seal No. 2 as the water component was slightly reduced. This change would facilitate an increase in the amount Part B in the mix and would increase the stiffness of the proprietary material.

During seal installation, underground information showing the orientation of the spray nozzle and extent of the seal construction were limited to observations made with a borehole video camera that was installed in the second borehole located about 30 ft away. All material used was brought to the site in redi-mix trucks and the various components were added to the proprietary mix using a small batch plant. Installation of the seal was initiated using the spray nozzle rotating through a 360 degree arc. Installation progressed smoothly and the material throw distance was about 20 ft on the B-Drift side and about 15 to 18 ft on the C-Drift Side. Again, the difference in throw distance is attributed to the slope of the mine floor. Spraying of the seal material continued along the 360 degree arc until it was decided by the engineers on the surface to only spray the C-Drift side. It was believed that approach would limit the size of the seal to approximately one-half the area of the cross-cut area and still allow for a sufficiently sized seal. Work was terminated for the day (due to closure of the local cement plant) after 35 $yd^3$ had been placed into the mine opening.

Spraying of seal material resumed the next day and seal material was sprayed along a 70 degree arc across the upslope C-drift side of the cross-cut. Pumping continued until about 40 $yd^3$ of material had been placed into the mine void. Pumping was terminated when it was determined that seal material had rolled back onto and enveloped the spray nozzle and this material could not be removed or moved away using the nozzle. In addition, it was thought that the underground visibility had diminished significantly (due to water vapor and fog accumulation in the mine) as observed through the downhole camera. Later it was also determined that a gasket in the downhole camera failed causing a build-up of water condensation and ultimately damaging the camera.

An underground examination of the seal void showed that the mine void appeared closed on one side of the borehole along the cross-cut, but a significant hole remained on the other side of the borehole. Therefore, it was thought that another attempt should be made to build a seal (called seal C) using the spray nozzle in the down slope area of the cross-cut towards the B-Drift and that viewing of the progress of construction might be easier because this operation would take place about 20 ft closer to the observation borehole. Some of the proprietary material from Seal B was removed from the area of the borehole and along the ribs to allow the spray nozzle unobstructed movement and to permit proprietary seal material to be sprayed the maximum distance from the borehole.

Mine Seal C

A fixed video camera was located below the second borehole because the downhole camera was damaged as noted previously. This camera would provide the same function as the downhole camera without compromising the in-mine communication restriction placed on this experiment. This camera was not moved or rotated and was positioned to provide a view across the total width of the cross-cut. The sealant material mix was altered somewhat from that used for seal B as the water component was again slightly reduced. This change would increase the stiffness of the proprietary material to minimize material flow away from the borehole on the down slope side of the cross-cut.

The construction of seal C began by rotating the spray nozzle back and forth through a 70 to 80 degree arc. The proprietary spray material was thrown a maximum distance from 20 to 22 ft from the borehole although most of the material seemed to be fall along an arc from 8 to 10 ft from the borehole. Pumping continued until about 37 $yd^3$ had been placed in the mine void when it was determined from the video camera that the proprietary material had been place to within a few inches of the mine roof. The resulting mine seal was a large bowl-shaped structure extending about 8 to 10 ft from the borehole. The addition of accelerator (Part B) to the spray was then stopped and grout was permitted to flow from the spray nozzle to help infill any remaining voids in the mass of the seal. Pumping was terminated after about 3 $yd^3$ of this material had been pumped and a total of 40 $yd^3$ was pumped to construct this seal.

Unfortunately the observations made using the video camera did not agree with the actual conditions in the mine void. The mine roof near the area of the borehole had been broken upward on the B-Drift side and this irregularity was obscured by the general slope of the mine roof towards the video camera location. Although the video images showed the front top (from the B-Drift side) of the seal to be at or near the mine roof, in fact, the seal was nearly 18 inches from the mine roof along an arc about 8 to 10 ft from the borehole. However, upon closer inspection, seal material was placed to within 4 to 6 ft, radially, from the borehole and was at the mine roof level completely across the mine opening.

Tests

Unconfined compressive tests were conducted on 3-in diameter cylinder samples (cylinder area—7.07 $in^2$) that were collected during seal construction. Samples were collected underground as the material was being placed in the mine void.

The compressive strength of the bulk fill material is substantially higher than that of the proprietary sprayed fill material. The reason for the lower compressive strength of the proprietary sprayed material is that the mix does not contain sand or aggregate and most likely had air bubbles trapped in the mixture from the mine seal material placement process. Unconfined compressive tests were conducted after 1, 2, and 3 days on samples collected from the proprietary sprayed material used to construct seal No. C. The results of these tests showed that the material achieves significant strength quickly and given sufficient seal thickness could, in all likelihood, withstand the force of a mine explosion shortly after installation. Also, there is an overall increase in compressive strength from one seal to another. This is a result of innovative alteration of the proprietary grout mix components as discussed earlier.

Although the major thrust of this research effort was aimed at development of proprietary material mixes and mine seal construction techniques, the benefits of constructing the seal at the LLEM included the option of testing the seal's ability to confine mine air and also to withstand the forces of a mine explosion. Air leakage tests were conducted on seal Nos. A and C by building a frame on one side of the mine seal and covering the frame with brattice cloth. Next an opening was made in the brattice cloth the size of an anemometer to facilitate air velocity measurements. Once this work was completed, air flow in the mine was adjusted to produce a desired differential pressure and the air leakage through the seal was measured. The results of the air leakage tests are shown in Table 1.

TABLE 1

Results of air leakage tests.

| | Seal A | | | Seal C[1] | | Seal C[2] | | |
|---|---|---|---|---|---|---|---|---|
| Pressure, inches of water gage | 0.52 | 1.05 | 1.52 | 0.8 | 1.5 | 0.85 | 1.5 | 2.25 |
| Air Leakage Rate, $ft^3$/min | 252 | 322 | 426 | 296 | 409 | 221 | 305 | 365 |

[1]Several holes were observed in rib-roof areas remaining from seal No. 3.
[2]Test performed after polyurethane foam was used to fill holes observed during initial test.

Prior to conducting the air leakage tests, several holes (on the order of about 1-in diameter) were observed in seal A near the mine roof area. Therefore, the air leakage values shown in the table were not totally unexpected. During the initial test of seal C several holes were observed in the rib-roof areas. The holes were created during the installation of seal C and the material left in place was the remnant of seal B. The holes were filled with polyurethane foam and the test was conducted again. The results of the second test on Seal C showed the air leakage rates were reduced after the polyurethane foam was applied. To determine where the where the seal leaked air, a fog machine was used to create smoke and was placed on the upwind side of the seal. Air pressure on that upwind side of the seal was increased to force the smoke through the seal. The smoke was observed at the mine roof areas on the downwind side of the seal. This observation was significant because it suggests that the proprietary seal material may not have been sprayed long enough to completely close the mine void or that the method used to complete the seal (as described earlier) eroded some of the sprayed proprietary seal material and created the holes. Also, it is important to note that leaks were not detected in the body of the seal, along the floor or rib areas.

An explosion test was conducted on mine seal A. The mine seal withstood a pressure of 18 psi with no visible signs of damage. To conduct the explosion test, a known quantity of methane gas was injected in the end of the C-Drift near the cross-cut where the seal A was installed. This area was temporarily closed with a frame and brattice cloth to confine the gas. The gas was diluted with air to achieve an explosive concentration. The gas was then ignited producing an explosion. An explosion test on seal C was not conducted because it was assumed that the seal was of significant thickness and strength and would withstand the force of an explosion (up to 20 psi).

While the present invention has been described in conjunction with the specific embodiments set forth above, many alternatives, modifications and other variations thereof will be apparent to those of ordinary skill in the art. All such alternatives, modifications and variations are intended to fall within the spirit and scope of the present invention.

The invention claimed is:

1. A remote mine seal spray nozzle assembly, comprising:

(a) a nozzle body comprising an outer casing end and an opposed, spray end, an inner conduit, and at least one outer conduit extending between the outer casing end and the spray end, the spray end comprising a multi-port manifold seat in fluid communication with the conduits; and (b) a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat, wherein the interior mixing chamber is defined within the nozzle between the grout inlet and the downstream spray outlet.

2. The remote mine seal spray nozzle assembly according to claim 1, wherein the multi-port manifold seat comprises a first channel in fluid communication with the inner conduit and a second channel in fluid communication with the at least one charging pressure port.

3. A remote mine seal spray nozzle assembly, comprising:

(a) a nozzle body comprising an outer casing end and an opposed, spray end, an inner conduit, and at least one outer conduit extending between the outer casing end and the spray end, the spray end comprising a multi-port manifold seat in fluid communication with the conduits; and (b) a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat, wherein the multi-port manifold seat comprises a first channel in fluid communication with the inner conduit and a second channel in fluid communication with the at least one charging pressure port, and further comprising a second outer conduit extending between the outer casing end and the spray end of the nozzle body, the second outer conduit being in fluid communication with a third channel formed in the multi-port manifold seat.

4. The remote mine seal spray nozzle assembly according to claim 3, further comprising: a third channel formed in the multi-port manifold seat and in fluid communication with the second outer conduit; and a second charging port defined in the nozzle downstream of the at least one charging port and in being in fluid communication with the third channel.

5. The remote mine seal spray nozzle assembly according to claim 1, wherein the nozzle comprises a second charging port downstream of the at least one charging port and in communication with the second channel.

6. A remote mine seal spray nozzle assembly, comprising:

(a) a nozzle body comprising an outer casing end and an opposed, spray end, an inner conduit, and at least one outer conduit extending between the outer casing end and the spray end, the spray end comprising a multi-port manifold seat in fluid communication with the conduits; and (b) a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat, wherein the nozzle body further comprises a second outer conduit, the multi-port manifold seat further comprises a first channel in fluid communication with the inner conduit, a second channel in fluid communication with the at least one charging pressure port, and a third channel in fluid communication with a second outer conduit; and wherein the nozzle comprises a second charging port downstream of the at least one charging port and in communication with the first channels.

7. The remote mine seal spray nozzle assembly according to claim 1, further comprising a retainer releasably capturing the nozzle in the multi-port manifold seat.

8. The remote mine seal spray nozzle assembly according to claim 1, wherein the nozzle body further comprises a blowout port in the spray end.

9. The remote mine seal spray nozzle assembly according to claim 1, wherein the nozzle body is substantially cylindrical about a first longitudinal axis, and the multi-port manifold seat establishes a substantially cylindrical recess about a spray throw axis that approximately defines an acute throw angle with respect to the first axis.

10. The remote mine seal spray nozzle assembly according to claim 1, wherein the multi-port manifold seat further comprises an annular first channel in fluid communication with the inner conduit and grout inlet; and an annular second channel in fluid communication with the charging pressure port and the at least one outer conduit.

11. The remote mine seal spray nozzle assembly according to claim 4, wherein the nozzle further comprises an actuation port in fluid communication with the third channel, wherein the nozzle coacts with the actuation port to adjust the diameter of the spray outlet.

12. A remote mine seal spray nozzle assembly, comprising:

(a) a nozzle body comprising an outer casing end and an opposed, spray end, an inner conduit, and at least one outer conduit extending between the outer casing end and the spray end, the spray end comprising a multi-port manifold seat in fluid communication with the conduits; and (b) a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat, wherein the nozzle further comprises a second outer conduit extending between the outer casing end and the spray end of the nozzle body, the second outer conduit being in fluid communication with a channel formed in the multi-port manifold seat; and an actuation port defined in the nozzle in communication with the channel, wherein the nozzle coacts with the actuation port to adjust the diameter of the spray outlet.

13. A remote mine seal spray nozzle assembly, comprising:

(a) a nozzle body comprising an outer casing end and an opposed, spray end, an inner conduit, and at least one outer conduit extending between the outer casing end and the spray end, the spray end comprising a multi-port manifold seat in fluid communication with the conduits; and (b) a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat, wherein the remote mine seal spray nozzle assembly further comprises:

a second outer conduit extending between the outer casing end and the spray end of the nozzle body, the second outer conduit being in fluid communication with a channel formed in the multi-port manifold seat; and an actuation port defined in the nozzle in communication with the channel;

wherein the nozzle body is substantially cylindrical about a first longitudinal axis;

wherein the multi-port manifold seat establishes a substantially cylindrical recess about a spray throw axis that approximately defines an acute throw angle with the first axis; and wherein the nozzle coacts with the actuation port to adjust the acute throw angle.

14. The remote mine seal spray nozzle assembly according to claim 1, wherein the outer diameter of the nozzle body is about 5½ inches.

15. A system for remote operator monitoring of a mine seal installation through an observation shaft using the remote mine seal spray nozzle assembly according to claim 1, further comprising:

a sensor positioned proximate the remote mine seal and communicating information through the observation shaft to the operator.

16. The system according to claim 15, wherein the sensor is an illuminating audio-visual device.

17. The system according to claim 15, wherein the sensor is an anemometer.

18. The system according to claim 15, wherein the sensor is an air flow visualization smoke trail generator.

19. A system for remote mine seal installation through a down shaft using the remote mine seal spray nozzle assembly according to claim 6, further comprising:

a first mix formed of a cementitious grout including a water reducer and a plasticizer, the first mix being communicated into the grout inlet of the mixing chamber;

a second mix formed of pressurized air and a temperature optimized accelerant, the second mix being communicated into the at least one charging pressure port of the mixing chamber and to the second charging port;

an atomized mine seal mix projected from the downstream spray outlet of the interior mixing chamber; and a mine seal formed from the accumulated mine seal mix wherein the mine seal mix rapidly hardens to form the mine seal.

20. A method for installing a remote mine seal through a bore hole using a remote mine seal spray nozzle assembly comprising a nozzle body comprising an outer casing end and an opposed, spray end, an inner conduit, and at least one outer conduit extending between the outer casing end and the spray end, the spray end comprising a multi-port manifold seat in fluid communication with the conduits; and a nozzle received in the multi-port manifold seat and defining an interior mixing chamber, the nozzle comprising a grout inlet in fluid communication with the inner conduit through the multi-port manifold seat, a downstream spray outlet opposite the grout inlet, and at least one charging pressure port therebetween, the charging pressure port being in fluid communication with the at least one outer conduit through the multi-port manifold seat; the method comprising the steps of:

a) positioning the remote mine seal spray nozzle assembly through a seal bore hole and about a seal installation area;

b) charging the outer conduit with pressurized gas and an accelerator;

c) charging the inner conduit with a spray material to be atomized in the interior mixing chamber by the pressurized gas and accelerator charge and to be discharged as mixed seal material through the spray outlet; and d) rotating the nozzle body and directing the discharged mixed seal material about the seal installation area to remotely install the mine seal.

21. The method according to claim 20, further comprising the step of:

e) injecting a grout resin about the seal installation area for reinforced shrinkage compensating sealing of a lift portion of the remotely installed seal.

22. The method according to claim 20, further comprising the step of:

e) monitoring the remote seal installation.

* * * * *

UNITED STATES PATENT AND TRADEMARK OFFICE

CERTIFICATE OF CORRECTION

PATENT NO. : 7,682,107 B2
APPLICATION NO. : 11/392288
DATED : March 23, 2010
INVENTOR(S) : Crayne et al.

It is certified that error appears in the above-identified patent and that said Letters Patent is hereby corrected as shown below:

Face of the Patent, see Item (75) Inventors: Add the following:
-- Phillip E. Glogowski, West Mifflin, PA (US) --

Column 18, Line 16, Claim 22: "e) monitoring" should read -- f) monitoring --

Signed and Sealed this

Tenth Day of August, 2010

David J. Kappos

David J. Kappos
*Director of the United States Patent and Trademark Office*